US007007670B2

(12) United States Patent
Okamoto et al.

(10) Patent No.: US 7,007,670 B2
(45) Date of Patent: Mar. 7, 2006

(54) FUEL INJECTION DEVICE

(75) Inventors: Kenji Okamoto, Higashi-Matsuyama (JP); Akira Kunishima, Higashi-Matsuyama (JP)

(73) Assignee: Bosch Automotive Systems Corporation, Tokyo (JP)

( * ) Notice: Subject to any disclaimer, the term of this patent is extended or adjusted under 35 U.S.C. 154(b) by 0 days.

(21) Appl. No.: 11/002,058

(22) Filed: Dec. 3, 2004

(65) Prior Publication Data

US 2005/0115533 A1 Jun. 2, 2005

Related U.S. Application Data

(62) Division of application No. 10/677,268, filed on Oct. 3, 2003, now Pat. No. 6,912,983.

(30) Foreign Application Priority Data

May 16, 2001 (JP) ..... 2001-146337

(51) Int. Cl.
*F02M 37/04* (2006.01)

(52) U.S. Cl. ..... 123/446; 123/458

(58) Field of Classification Search ..... 123/458, 123/446, 447, 456, 457

See application file for complete search history.

(56) References Cited

U.S. PATENT DOCUMENTS

| | | | | |
|---|---|---|---|---|
| 4,487,188 | A | 12/1984 | Inoue et al. | 123/491 |
| 5,558,068 | A * | 9/1996 | Kunishima et al. | 123/516 |
| 5,598,817 | A * | 2/1997 | Igarashi et al. | 123/179.17 |
| 5,758,622 | A * | 6/1998 | Rembold et al. | 123/456 |
| 5,839,413 | A | 11/1998 | Krause et al. | 123/447 |
| RE36,119 | E | 3/1999 | Kunishima et al. | 123/516 |
| 6,021,763 | A * | 2/2000 | Yoshihara et al. | 123/516 |
| 6,267,104 | B1 | 7/2001 | Monnier | 123/516 |

FOREIGN PATENT DOCUMENTS

JP 10-54318 2/1998

* cited by examiner

*Primary Examiner*—Thomas Moulis
(74) *Attorney, Agent, or Firm*—Wenderoth, Lind & Ponack, L.L.P.

(57) ABSTRACT

In a state in which a high-pressure control solenoid valve is driven to control the pressure in a common rail (refer to Step S100), when the pressure in the common rail exceeds a predetermined value (refer to Step S104), a driving current determined by a prescribed value map that defines the correlation between the pressure in the common rail and the driving current of the high-pressure control solenoid valve is corrected based on an actual pressure in the common rail and the driving current of the high-pressure control solenoid valve at the actual pressure (refer to Steps S106, 108, S110, 112), and the corrected driving current is passed to the high-pressure control solenoid valve, thereby ensuring appropriate and stable injection control even when there exists a variation in operational characteristics among pressure control valves.

4 Claims, 10 Drawing Sheets

FUEL INJECTION DEVICE

This is a divisional application of U.S. patent application Ser. No. 10/677,268, filed Oct. 3, 2003, now U.S. Pat. No. 6,912,983.

FIELD OF THE INVENTION

The present invention relates to an operation control method in a fuel injection device that injects and supplies a fuel to an internal combustion engine, and to the fuel injection device. More particularly, it relates to those devices and methods in which enhancement in control stability and so on are realized.

DESCRIPTION OF THE RELATED ART

In recent years, as one type of a fuel injection device that injects and supplies a fuel to an internal combustion machine such as an engine, proposed are various fuel injection devices called common-rail fuel injection devices that are configured so that a high-pressure fuel is temporarily stored in a fuel passage called a common rail. Thereafter, a plurality of injection nozzles connected to this common rail, each having a solenoid valve, are controlled to thereby enable concurrent injection. These devices are now well known in the art (for example, refer to Japanese Patent Laid-open No. Hei 10-54318).

In such a common-rail fuel injection device, whether or not an injection characteristic is good greatly depends on stability and reliability in controlling the pressure in the common rail, namely, the common-rail pressure, at a target pressure. This common-rail pressure control is roughly classified, in terms of the positions where the control is performed, into a high-pressure side control, in which pressure control is performed on a high-pressure side (in other words, on a downstream side of a high-pressure pump for pressure-sending a fuel to the common rail so as to cause the common rail pressure to be a desired pressure), and a low-pressure control, in which common-rail pressure control is performed on an upstream side of the high-pressure pump. Each class of control has its own merits and demerits, and although various control methods and control devices have been conventionally proposed in which the respective merits and demerits thereof are taken into consideration, they cannot still be said to be satisfactory.

Further, the conventional fuel injection devices are configured so that various controls are performed under the assumption that operational characteristics, such as a valve opening characteristic of a pressure control valve having a solenoid valve, are equal to presumed characteristics. In practice, however, there sometimes occur variations among individual pressure control valves, and it is desired that originally targeted stable and reliable injection control should be performed even when there are such variations in the characteristics.

SUMMARY OF THE INVENTION

The present invention is made from the above viewpoint, and an object thereof is to provide an operation control method using a fuel injection device and the fuel injection device that enable appropriate control of the common-rail pressure in accordance with various operation states of the fuel injection device.

Another object of the present invention is to provide an operation control method in a fuel injection device and the fuel injection device that enable the execution of originally targeted injection controls, even if there are variations in operational characteristics among pressure control valves.

According to a form of a first invention, provided is an operation control method using a fuel injection device including: a high-pressure pump that pressure-sends a fuel in a fuel tank; a common rail in which the fuel pressure-sent by the high-pressure pump is temporarily stored; a plurality of injection nozzles attached to the common rail, each having a solenoid valve; a low-pressure control solenoid valve provided between the fuel tank and the high-pressure pump; a high-pressure control solenoid valve provided in an area from the high-pressure pump up to the injection nozzles; and a control unit that controls an operation of the high-pressure pump, the respective solenoid valves of the plural injection nozzles, the low-pressure control solenoid valve, and the high-pressure control solenoid valve.

The method is conducted so that, when a pressure in the common rail exceeds a predetermined value in a state in which the high-pressure control solenoid valve is driven to control the pressure in the common rail, a driving current determined by a prescribed value map defining a correlation between the pressure in the common rail and the driving current of the high-pressure control solenoid valve is corrected based on an actual pressure in the common rail and a driving current of the high-pressure control solenoid valve at the actual pressure, and the corrected driving current is passed to the high-pressure control solenoid valve.

With such a configuration, the driving current of the high-pressure control solenoid valve that is determined by the prescribed value map is corrected according to an actual driving state under a predetermined condition. Therefore it is possible to realize appropriate and reliable fuel injection in response to variations in operational characteristics among high-pressure control solenoid valves and a difference in operational conditions among individual devices.

According to a form of a second invention, provided is an operation control method using a fuel injection device including: a high-pressure pump that pressure-sends a fuel in a fuel tank; a common rail in which the fuel pressure-sent by the high-pressure pump is temporarily stored; a plurality of injection nozzles attached to the common rail, each having a solenoid valve; a low-pressure control solenoid valve provided between the fuel tank and the high-pressure pump; a high-pressure control solenoid valve provided in an area from the high-pressure pump up to the injection nozzles; and a control unit that controls an operation of the high-pressure pump, the respective solenoid valves of the plural injection nozzles, the low-pressure control solenoid valve, and the high-pressure control solenoid valve.

The method is conducted so that, when an engine is in a predetermined start-up state, the high-pressure control solenoid valve is controlled to be driven until a predetermined period of time passes after the engine is activated, thereby controlling a pressure in the common rail.

In such an operation control method, when the engine is in the start-up state, the high-pressure control solenoid valve is driven in a manner appropriate for causing the common-rail pressure to quickly fall within a stable range, so that stable and reliable fuel injection control can be realized.

According to a form of a third invention, provided is an operation control method using a fuel injection device including: a high-pressure pump that pressure-sends a fuel in a fuel tank; a common rail in which the fuel pressure-sent by the high-pressure pump is temporarily stored; a plurality of injection nozzles attached to the common rail, each having a solenoid valve; a low-pressure control solenoid valve provided between the fuel tank and the high-pressure pump; a high-pressure control solenoid valve provided in an area from the high-pressure pump up to the injection nozzles; and a control unit that controls an operation of the high-pressure pump, the respective solenoid valves of the plural injection nozzles, the low-pressure control solenoid valve, and the high-pressure control solenoid valve.

The method is conducted so that, when an absolute value of a variation amount of a pressure in the common rail exceeds a predetermined value, the high-pressure control solenoid valve is controlled to be driven, thereby controlling the pressure in the common rail.

According to a form of a fourth invention, provided is an operation control method using a fuel injection device including: a high-pressure pump that pressure-sends a fuel in a fuel tank; a common rail in which the fuel pressure-sent by the high-pressure pump is temporarily stored; a plurality of injection nozzles attached to the common rail, each having a solenoid valve; a low-pressure control solenoid valve provided between the fuel tank and the high-pressure pump; a high-pressure control solenoid valve provided in an area from the high-pressure pump up to the injection nozzles; and a control unit that controls an operation of the high-pressure pump, the respective solenoid valves of the plural injection nozzles, the low-pressure control solenoid valve, and the high-pressure control solenoid valve.

The method is conducted so that, when a fluctuation of a driving torque of the high-pressure pump exceeds a predetermined state, the high-pressure control solenoid valve is controlled to be driven, thereby controlling a pressure in the common rail.

According to a form of a fifth invention, provided is an operation control method in a fuel injection device including: a high-pressure pump that pressure-sends a fuel in a fuel tank; a common rail in which the fuel pressure-sent by the high-pressure pump is temporarily stored; a plurality of injection nozzles attached to the common rail, each having a solenoid valve; a low-pressure control solenoid valve provided between the fuel tank and the high-pressure pump; a high-pressure control solenoid valve provided in an area from the high-pressure pump up to the injection nozzles; and a control unit that controls an operation of the high-pressure pump, the respective solenoid valves of the plural injection nozzles, the low-pressure control solenoid valve, and the high-pressure control solenoid valve.

The method is conducted so that, when an average driving torque of the high-pressure pump exceeds a predetermined state, the low-pressure control solenoid valve is controlled to be driven, thereby controlling a pressure in the common rail.

According to a form of a sixth invention, provided is an operation control method in a fuel injection device including: a high-pressure pump that pressure-sends a fuel in a fuel tank; a common rail in which the fuel pressure-sent by the high-pressure pump is temporarily stored; a plurality of injection nozzles attached to the common rail, each having a solenoid valve; a low-pressure control solenoid valve provided between the fuel tank and the high-pressure pump; a high-pressure control solenoid valve provided in an area from the high-pressure pump up to the injection nozzles; and a control unit that controls an operation of the high-pressure pump, the respective solenoid valves of the plural injection nozzles, the low-pressure control solenoid valve, and the high-pressure control solenoid valve.

The method is conducted so that, when a fuel temperature is in a predetermined high-temperature state and the high-pressure control solenoid valve is being driven, the low-pressure control solenoid valve is controlled to be driven instead of driving the high-pressure control solenoid valve, until the fuel temperature falls within a predetermined reference temperature range, thereby controlling a pressure in the common rail.

When the fuel temperature is in a predetermined low-temperature state and the low-pressure control solenoid valve is being driven, the high-pressure control solenoid valve is controlled to be driven instead of driving the low-pressure control solenoid valve, until the fuel temperature falls within the predetermined reference temperature range, thereby controlling the pressure in the common rail.

According to a form of a seventh invention, provided is an operation control method using a fuel injection device including: a high-pressure pump that pressure-sends a fuel in a fuel tank; a common rail in which the fuel pressure-sent by the high-pressure pump is temporarily stored; a plurality of injection nozzles attached to the common rail, each having a solenoid valve; a low-pressure control solenoid valve provided between the fuel tank and the high-pressure pump; a high-pressure control solenoid valve provided in an area from the high-pressure pump up to the injection nozzles; and a control unit that controls an operation of the high-pressure pump, the respective solenoid valves of the plural injection nozzles, the low-pressure control solenoid valve, and the high-pressure control solenoid valve.

The method is conducted so that, when the fuel injection device is in a predetermined unstable operation state, the high-pressure control solenoid valve is controlled to be driven, thereby controlling a pressure in the common rail.

According to a form of an eighth invention, provided is a fuel injection device including: a high-pressure pump that pressure-sends a fuel in a fuel tank; a common rail in which the fuel pressure-sent by the high-pressure pump is temporarily stored; a plurality of injection nozzles attached to the common rail, each having a solenoid valve; a low-pressure control solenoid valve provided between the fuel tank and the high-pressure pump; a high-pressure control solenoid valve provided in an area from the high-pressure pump up to the injection nozzles; and a control unit that controls an operation of the high-pressure pump, the respective solenoid valves of the plural injection nozzles, the low-pressure control solenoid valve, and the high-pressure control solenoid valve.

The control unit is configured to control the low-pressure control solenoid valve and the high-pressure control solenoid valve so that they are selectively driven based on a temperature of the fuel, a pressure in the common rail, an engine rotation speed, an accelerator depression amount, and position information of an ignition engine key that are inputted from an external part. The control unit has a prescribed value map stored therein that defines a correlation between the pressure in the common rail and a driving current of the high-pressure control solenoid valve.

When controlling the high-pressure control solenoid valve to be driven, the control unit determines the driving current of the high-pressure control solenoid valve for a desired pressure in the common rail based on the prescribed value map and passes the determined driving current to the high-pressure control solenoid valve until the pressure in the common rail is judged to exceed a predetermined variation amount. When the pressure in the common rail is judged to exceed a predetermined value, the control unit corrects the driving current determined by the prescribed value map based on an actual pressure in the common rail and the driving current of the high-pressure control solenoid valve at the actual pressure, and passes the corrected driving current to the high-pressure control solenoid valve.

According to a form of a ninth invention, provided is a fuel injection device including: a high-pressure pump that pressure-sends a fuel in a fuel tank; a common rail in which the fuel pressure-sent by the high-pressure pump is temporarily stored; a plurality of injection nozzles attached to the common rail, each having a solenoid valve; a low-pressure control solenoid valve provided between the fuel tank and the high-pressure pump; a high-pressure control solenoid valve provided in an area from the high-pressure pump up to the injection nozzles; and a control unit that controls an operation of the high-pressure pump, the respective solenoid valves of the plural injection nozzles, the low-pressure control solenoid valve, and the high-pressure control solenoid valve.

The control unit is configured to control the low-pressure control solenoid valve and the high-pressure control solenoid valve so that they are selectively driven based on a temperature of the fuel, a pressure in the common rail, an engine rotation speed, an accelerator depression amount, and position information of an ignition engine key that are inputted from an external part. As a result of judgment of whether or not an engine is in a predetermined start-up state, when the engine is judged to be in the predetermined start-up state, the control unit controls the high-pressure control solenoid valve so that it is driven until a predetermined period of time passes after the engine is activated. When the engine is judged not to be in the predetermined start-up state, the control unit drives the low-pressure control solenoid valve.

According to a form of a tenth invention, provided is a fuel injection device including: a high-pressure pump that pressure-sends a fuel in a fuel tank; a common rail in which the fuel pressure-sent by the high-pressure pump is temporarily stored; a plurality of injection nozzles attached to the common rail, each having a solenoid valve; a low-pressure control solenoid valve provided between the fuel tank and the high-pressure pump; a high-pressure control solenoid valve provided in an area from the high-pressure pump up to the injection nozzles; and a control unit that controls an operation of the high-pressure pump, the respective solenoid valves of the plural injection nozzles, the low-pressure control solenoid valve, and the high-pressure control solenoid valve.

The control unit is configured to control the low-pressure control solenoid valve and the high-pressure control solenoid valve to be selectively driven based on a temperature of the fuel, a pressure in the common rail, an engine rotation speed, an accelerator depression amount, and position information of an ignition engine key that are inputted from an external part. As a result of judgment of whether or not an absolute value of a variation amount of the pressure in the common rail exceeds a predetermined value, when the absolute value of the variation amount of the pressure in the common rail is judged to exceed the predetermined value, the control unit controls the high-pressure control solenoid valve to be driven. When the absolute value of the variation amount of the pressure in the common rail is judged not to exceed the predetermined value, the control unit controls the low-pressure control solenoid valve to be driven.

According to a form of an eleventh invention, provided is a fuel injection device including: a high-pressure pump that pressure-sends a fuel in a fuel tank; a common rail in which the fuel pressure-sent by the high-pressure pump is temporarily stored; a plurality of injection nozzles attached to the common rail, each having a solenoid valve; a low-pressure control solenoid valve provided between the fuel tank and the high-pressure pump, a high-pressure control solenoid valve provided in an area from the high-pressure pump up to the injection nozzles; and a control unit that controls an operation of the high-pressure pump, the respective solenoid valves of the plural injection nozzles, the low-pressure control solenoid valve, and the high-pressure control solenoid valve.

The control unit is configured to control the low-pressure control solenoid valve and the high-pressure control solenoid valve so that they are selectively driven based on a temperature of the fuel, a pressure in the common rail, an engine rotation speed, an accelerator depression amount, and position information of an ignition engine key that are inputted from an external part. As a result of judgment of whether or not a fluctuation of a driving torque of the high-pressure pump exceeds a predetermined state, when the fluctuation of the driving torque of the high-pressure pump is judged to exceed the predetermined state, the control unit controls the high-pressure control solenoid valve to be driven. When the fluctuation of the driving torque of the high-pressure pump is judged not to exceed the predetermined state, the control unit controls the low-pressure control solenoid valve to be driven.

According to a form of a twelfth invention, provided is a fuel injection device including: a high-pressure pump that pressure-sends a fuel in a fuel tank; a common rail in which the fuel pressure-sent by the high-pressure pump is temporarily stored; a plurality of injection nozzles attached to the common rail, each having a solenoid valve; a low-pressure control solenoid valve provided between the fuel tank and the high-pressure pump; a high-pressure control solenoid valve provided in an area from the high-pressure pump up to the injection nozzles; and a control unit that controls an operation of the high-pressure pump, the respective solenoid valves of the plural injection nozzles, the low-pressure control solenoid valve, and the high-pressure control solenoid valve.

The control unit is configured to control the low-pressure control solenoid valve and the high-pressure control solenoid valve so that they are selectively driven based on a temperature of the fuel, a pressure in the common rail, an engine rotation speed, an accelerator depression amount, and position information of an ignition engine key that are inputted from an external part. As a result of judgment of whether or not an average driving torque of the high-pressure pump exceeds a predetermined state, when the average driving torque of the high-pressure pump is judged to exceed the predetermined state, the control unit controls the low-pressure control solenoid valve to be driven.

When the average driving torque of the high-pressure pump is judged not to exceed the predetermined state, the control unit controls the high-pressure control solenoid valve to be driven.

According to a form of a thirteenth invention, provided is a fuel injection device including: a high-pressure pump that pressure-sends a fuel in a fuel tank; a common rail in which the fuel pressure-sent by the high-pressure pump is temporarily stored; a plurality of injection nozzles attached to the common rail, each having a solenoid valve; a low-pressure control solenoid valve provided between the fuel tank and the high-pressure pump; a high-pressure control solenoid valve provided in an area from the high-pressure pump up to the injection nozzles; and a control unit that controls an operation of the high-pressure pump, the respective solenoid valves of the plural injection nozzles, the low-pressure control solenoid valve, and the high-pressure control solenoid valve.

The control unit is configured to control the low-pressure control solenoid valve and the high-pressure control solenoid valve to be selectively driven based on a temperature of the fuel, a pressure in the common rail, an engine rotation speed, an accelerator depression amount, and position information of an ignition engine key that are inputted from an external part. As a result of judgment of whether or not a temperature of the fuel is in a predetermined high temperature state, when the temperature of the fuel is judged to be in the predetermined high temperature state, the control unit judges whether or not the high-pressure control solenoid valve is being driven. When the high-pressure control solenoid valve is judged to be being driven, the control unit controls the low-pressure control solenoid valve to be driven instead of driving the high-pressure control solenoid valve, until the temperature of the fuel falls within a predetermined reference temperature range. When the high-pressure control solenoid valve is judged not to be being driven, the control unit controls the low-pressure control solenoid valve to be driven until the temperature of the fuel falls within the predetermined reference temperature range.

When the temperature of the fuel is judged not to be in the predetermined high temperature state, the control unit judges whether or not the temperature of the fuel is in a predetermined low temperature state. When the temperature of the fuel is judged to be in the predetermined low temperature state, the control unit judges whether or not the low-pressure control solenoid valve is being driven. When the low-pressure control solenoid valve is judged to be in the driven state, the control unit controls the high-pressure control solenoid valve to be driven in place of driving the low-pressure control solenoid valve until the temperature of the fuel falls within the predetermined reference temperature range. When the low-pressure control solenoid valve is judged not to be in the driven state, the control unit controls the high-pressure control solenoid valve to be driven until the temperature of the fuel falls within the predetermined reference temperature range.

According to a form of a fourteenth invention, provided is a fuel injection device including: a high-pressure pump that pressure-sends a fuel in a fuel tank; a common rail in which the fuel pressure-sent by the high-pressure pump is temporarily stored; a plurality of injection nozzles attached to the common rail, each having a solenoid valve; a low-pressure control solenoid valve provided between the fuel tank and the high-pressure pump; a high-pressure control solenoid valve provided in an area from the high-pressure pump up to the injection nozzles; and a control unit that controls an operation of the high-pressure pump, the respective solenoid valves of the plural injection nozzles, the low-pressure control solenoid valve, and the high-pressure control solenoid valve.

The control unit is configured to control the low-pressure control solenoid valve and the high-pressure control solenoid valve so that they are selectively driven based on a temperature of the fuel, a pressure in the common rail, an engine rotation speed, an accelerator depression amount, and position information of an ignition engine key that are inputted from an external part. As a result of judgment of whether or not a state of fuel injection control is a predetermined unstable operation state, when the state of the fuel injection control is judged to be the predetermined unstable operation state, the control unit controls the high-pressure control solenoid valve to be driven. When the state of the fuel injection control is judged not to be the predetermined unstable operation state, the control unit controls the low-pressure control solenoid valve to be driven.

DETAILED DESCRIPTION OF THE PREFERRED EMBODIMENTS

A more detailed explanation of the present invention will be given with reference to the attached drawings.

It is to be understood that the members, arrangement, and so on explained below are not to limit the present invention, and various changes and modifications can be made within the sprit and scope of the present invention.

Figure 1:
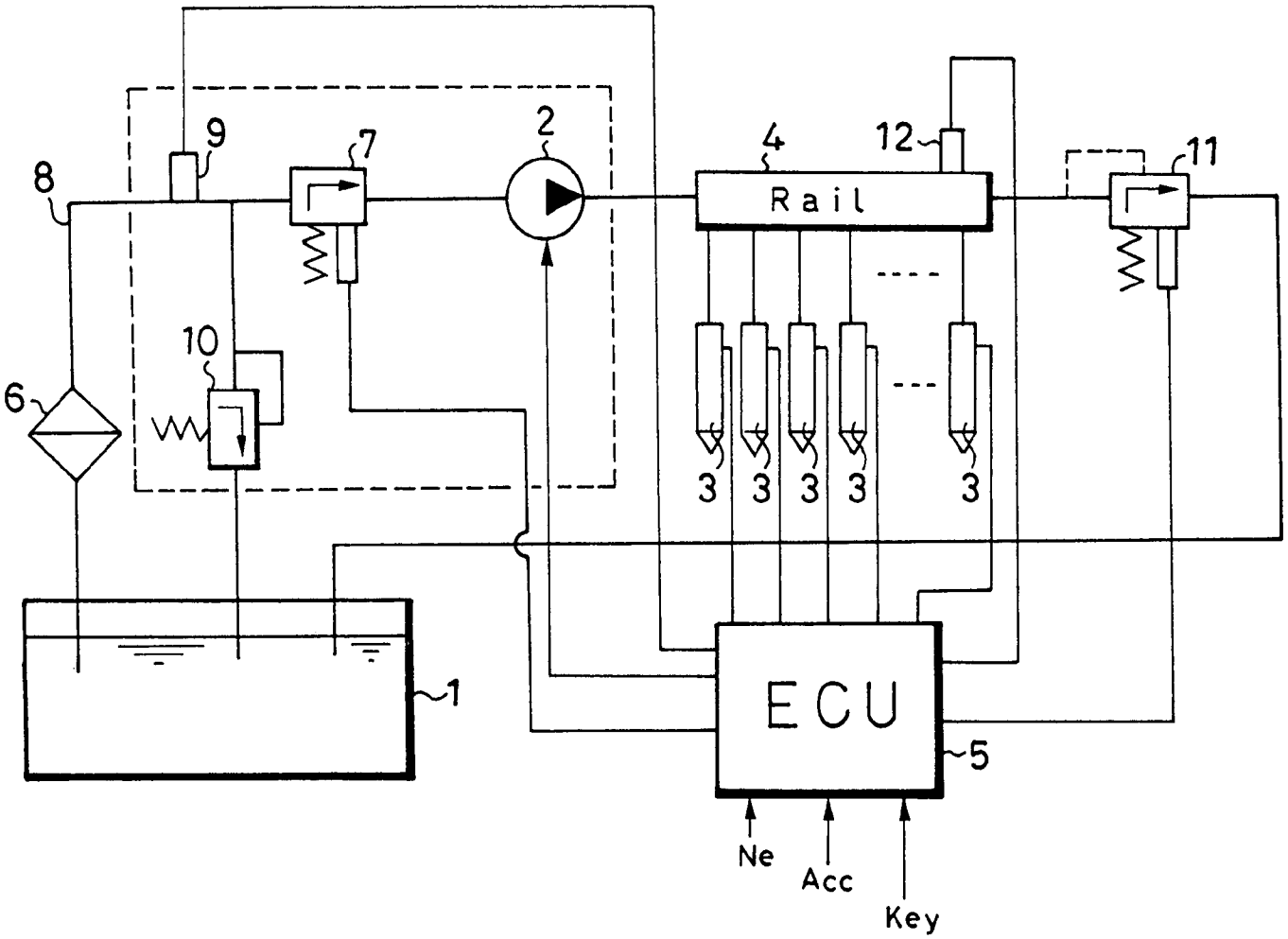
FIG. 1 is a block diagram showing a sample configuration of a common-rail fuel injection device according to an embodiment of the present invention.

First, the configuration of a common-rail fuel injection device according to an embodiment of the present invention (hereinafter, referred to as "this device") will be explained with reference to FIG. 1.

First, the rough configuration of this device is such that fuel stored in a fuel tank 1 is pressure-sent (i.e., pumped), via a high-pressure pump 2, to a common rail 4 to which a plurality of injection nozzles are connected. An operation of solenoid valves installed in the injection nozzles 3 is controlled by a control unit (denoted by 'ECU' in FIG. 1) 5, so that fuel injection from the injection nozzles 3 is controlled.

Hereinafter, the configuration of this device will be more specifically explained.

First, between the fuel tank 1 and a low-pressure (i.e., upstream) side of the high-pressure pump 2, a filter 6 for removing dust and so on from the fuel and a low-pressure control solenoid valve 7 are disposed in this order from the fuel tank 1 side, and they are coupled to each other by a fuel pipe 8. Then, a fuel temperature sensor (hereinafter, referred to as a "fuel temp. sensor") 9 is provided at an appropriate position in the fuel pipe 8 between the filter 6 and the low-pressure control solenoid valve 7, and an output signal thereof is transmitted to the control unit 5, which will be described later. Further, a mechanical low-pressure control valve 10 is provided between an appropriate position, which is somewhere in the fuel pipe 8 between the filter 6 and the low-pressure control solenoid valve 7, and the fuel tank 1. When receiving a predetermined valve opening pressure, the control valve 10 moves to an open state so that the fuel between the low-pressure control solenoid valve 7 and the filter 6 is discharged to the fuel tank 1.

A high-pressure (downstream) side of the high-pressure pump 2 is directly coupled to an inlet side of the common rail 4 by the fuel pipe 8.

An outlet side of the common rail 4 is connected to the fuel tank 1 by the fuel pipe 8 via a high-pressure control solenoid valve 11. Further, a high-pressure sensor 12 for detecting the common rail pressure is also disposed at an appropriate position at the common rail 4, and an output signal thereof is inputted to the control unit 5, which will be described next.

The control unit 5 is configured to execute, as will be described later, software to control the operation of the low-pressure control solenoid valve 7, the high-pressure control solenoid valve 11, and the not-shown solenoid valves in the injection nozzles 3, which were previously mentioned. Specifically, the control unit 5 is constituted of, for example, a so-called microcontroller, various kinds of interface circuits, and so on.

The output signals of the fuel temp. sensor 9 and the high-pressure sensor 12 are inputted to the control unit 5 as described above, and a rotation speed Ne of an engine (not shown), and a depression amount Acc of an accelerator (not shown), position information Key of a so-called ignition engine key (not shown) for use in starting a vehicle are inputted thereto.

Note that, in this device, driving control of the low-pressure control solenoid valve 7 by the control unit 5 is called open control, in which a driving current is simply outputted to the low-pressure control solenoid valve 7 from the control unit 5, but no feedback of a difference between the result thereof and a target driving state is given. On the other hand, driving control of the high-pressure control solenoid valve 11 by the control unit 5 is called feedback control, in which the driving current by the control unit 5 to the high-pressure control solenoid valve 11 is adjusted based on the output signal of the high-pressure sensor 12 (i.e., operational feedback) so as to make the common rail pressure equal to a desired pressure. Therefore, though this is for a case of high-pressure control, in a case of low-pressure control, the low-pressure control solenoid valve 7 is feedback-controlled, whereas the high-pressure control solenoid valve 11 is kept open.

Next, a first operation control example executed in the configuration described above will be explained with reference to FIG. 2 to FIG. 5.

First, in this first operation control example, a preset control pattern, especially with respect to the operation control of the high-pressure control solenoid valve 11, is corrected based on data from an actual operation, and the operation of the high-pressure control solenoid valve 11 is controlled based on the corrected data. In other words, the driving current of the high-pressure control solenoid valve 11 is determined according to the common rail pressure in the common rail 4 based on a table, an arithmetic expression, or the like that defines the correlation between the common rail pressure and the driving current, which is preset in a predetermined memory area of the control unit 5, and the valve opening state (or valve closing state) is determined by this driving current, so that a desired common rail pressure is obtained. In this case, the correlation between the common rail pressure and the driving current of the high-pressure control solenoid valve 11 has been defined based on the premise that the valve opening characteristic (or the valve closing characteristic) of the high-pressure control solenoid valve 11 for 10 a driving current is constantly a certain presumed characteristic. In actuality, the valve opening characteristic (or the valve closing characteristic) for the driving current often varies depending on individual high-pressure control solenoid valves 11. Further, the valve opening characteristic (or the valve closing characteristic) for a driving current of a single high-pressure control solenoid valve 11 sometimes differs from that when it is incorporated in the device actually used.

This first operation control example can realize operation control conforming to the actual operation in such a manner that the preset driving current of the high-pressure control solenoid valve 11 is corrected according to a desired common rail pressure based on the correlation between the driving current in the actual operation and the common rail pressure obtained by this driving current, and realizes so-called learning-based operation control.

Hereinafter, the process of this operation control will be specifically explained with reference to FIG. 2 to FIG. 5. First, a series of operation control steps shown in FIG. 2 are executed as one subroutine process in a main routine process (not-shown) including other control processes executed by the control unit 5.

Figure 2:
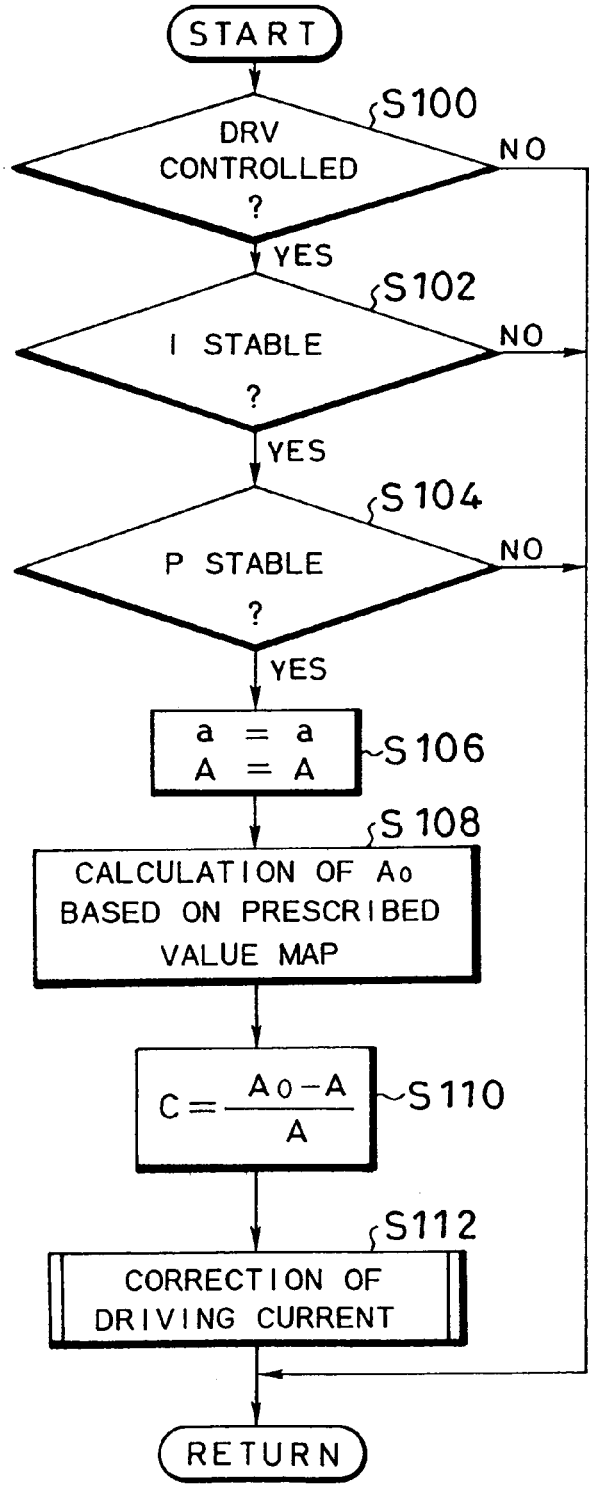
FIG. 2 is a flowchart showing the process of learning-based control procedure executed in a control unit in the common-rail fuel injection device shown in FIG. 1.

When this first operation control is started, it is first determined whether or not the high-pressure control solenoid valve 11 is in an operation state (refer to Step S100 in FIG. 2). Note that 'DRV' denotes the high-pressure control solenoid valve 11 in Step S100 in FIG. 2. The reason why it is judged here whether or not the high-pressure control solenoid valve 11 is in a predetermined driving state is that the common-rail fuel injection device to which this operation control is applied has the low-pressure control solenoid valve 7 and the high-pressure control solenoid valve 11 as previously explained with reference to FIG. 1, and it is premised that this device is configured to change the use thereof according to the operation state.

As criteria for determining whether or not the high-pressure control solenoid valve 11 is in the predetermined driving state, the state in which the common rail pressure is set to a predetermined pressure or higher (for example, 1000 bar or higher) by driving the high-pressure control solenoid valve 11 may be determined.

When it is determined in this Step S100 that the high-pressure control solenoid valve 11 is in the predetermined driving state (in a case of YES), the control process proceeds to Step S102 to be described next. When it is determined that the high-pressure control solenoid valve 11 is not in the predetermined driving state (in a case of NO), the current state is considered as not appropriate for the execution of this operation control (in other words, a learning process), and the control returns to the not-shown main routine process.

In Step S102, it is determined whether or not the driving current outputted from the control unit 5 to the high-pressure control solenoid valve 11 is in a predetermined stable state. Here, it is suitable that the determination as to whether or not the driving current is in the predetermined stable state is made based on, for example, whether or not the driving current is in a predetermined fluctuation range (for example, within 10% of the driving current that is currently desired).

Then, when it is determined that the driving current is in the predetermined stable state (in a case of YES), the control proceeds to Step S104 to be described next. When it is judged that the driving current is not in the predetermined stable state (in a case of NO), the current state is considered as not appropriate for the execution of the learning process, similarly to the previous case of the process in Step S100, and the control returns to the not-shown main routine process.

In Step S104, it is determined whether or not the common rail pressure is in a predetermined stable state. It is suitable here that the determination as to whether or not the common rail pressure is in the predetermined stable state is made based on, for example, whether or not the common rail pressure is within a predetermined fluctuation range (for example, within 10% of the common rail pressure desired at the current moment).

Then, when it is determined that the common rail pressure is in the predetermined stable state (in a case of YES), the control proceeds to a process in Step S106 to be described next. When it is determined that the common rail is not in the predetermined stable state (in a case of NO), the current state is considered as not appropriate for the execution of the learning process, similarly to the previous case in Step S100, and the control returns to the not-shown main routine process.

In Step S106, a value a of the common rail pressure detected by the high pressure sensor 12 is substituted for a variable a. At the same time, a driving current value A outputted from the control unit 5 to the high-pressure control solenoid valve 11 at that time is set as a variable A. In other words, operational feedback such as common rail pressure and the driving current to the high-pressure control solenoid valve 11 is obtained so as to be used to control the solenoid valve 11, as will be explained below.

Figure 4:
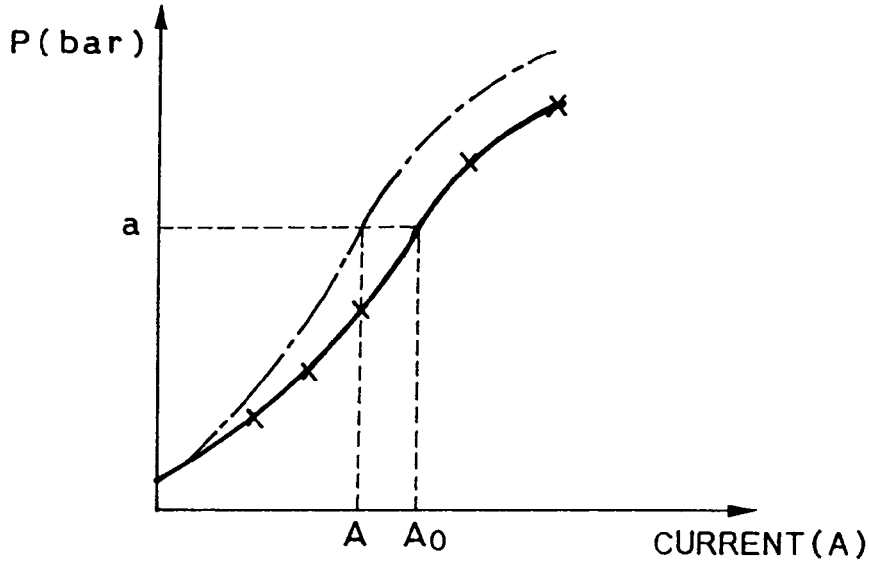
FIG. 4 is an explanatory chart explaining the process of deriving a driving current $A_0$ corresponding to an actually measured common rail pressure, using a prescribed value map showing the correlation between common rail pressure and driving current of a high-pressure control solenoid valve.
Figure 5:
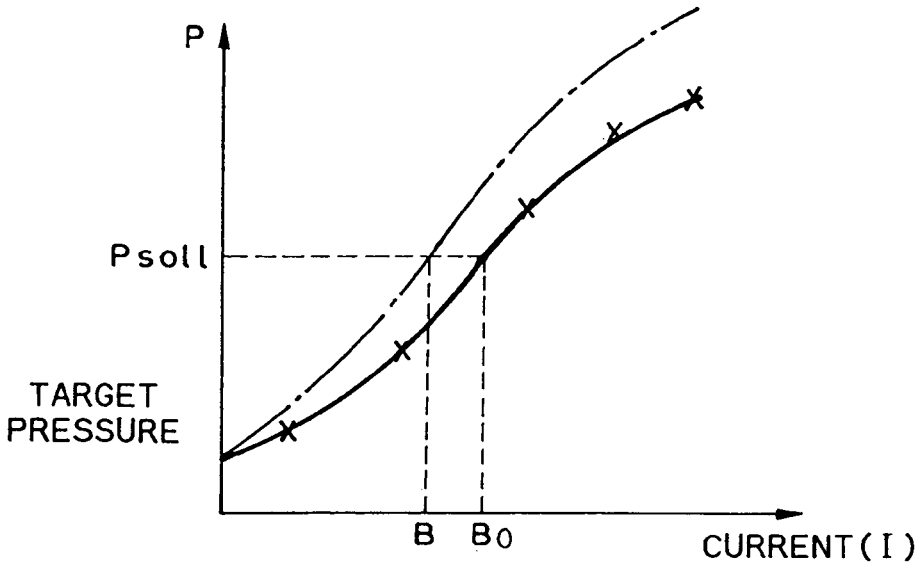
FIG. 5 is an explanatory chart explaining the process of deriving a driving current $B_0$ corresponding to a target common rail pressure, using the prescribed value map showing the correlation between common rail pressure and driving current of the high-pressure control solenoid valve.

Next, the control process proceeds to Step S108, in which a driving current value $A_0$ of the high-pressure control solenoid valve 11 for the actual common rail pressure a at the current moment is derived based on a prescribed value map (i.e., graph or table), which is stored in a not-shown memory area of the control unit 5 in advance. This value map represents the correlation between the driving current of the high-pressure control solenoid valve 11 and the common rail pressure. Note that FIG. 4 shows an example of the prescribed value map. In this drawing, the characteristic line depicted with the solid line is the prescribed value map representing the correlation between the driving current and the common rail pressure, and the characteristic line depicted with the dashed line represents the correlation, which is assumed at the current moment, between the actually measured common rail pressure a and the driving current.

Next, the control proceeds to Step S110, where a ratio C of a difference between the driving current $A_0$ based on the prescribed value map and the actual driving current A to the actual driving current A (hereinafter, this C is referred to as a 'correction coefficient' for convenience' sake) is calculated.

Next, a correction of the driving current is executed (refer to Step S112 in FIG. 2). Specifically, in this correction of the driving current, which is a subroutine as shown in FIG. 3, a driving current $B_0$ of the high-pressure control solenoid valve 11 for a desired common rail pressure $P_{soll}$ is first derived based on the aforesaid prescribed value map, where $P_{soll}$ is the common rail pressure desired at the current moment (refer to Step S112*a* in FIG. 3 and FIG. 5).

Figure 3:
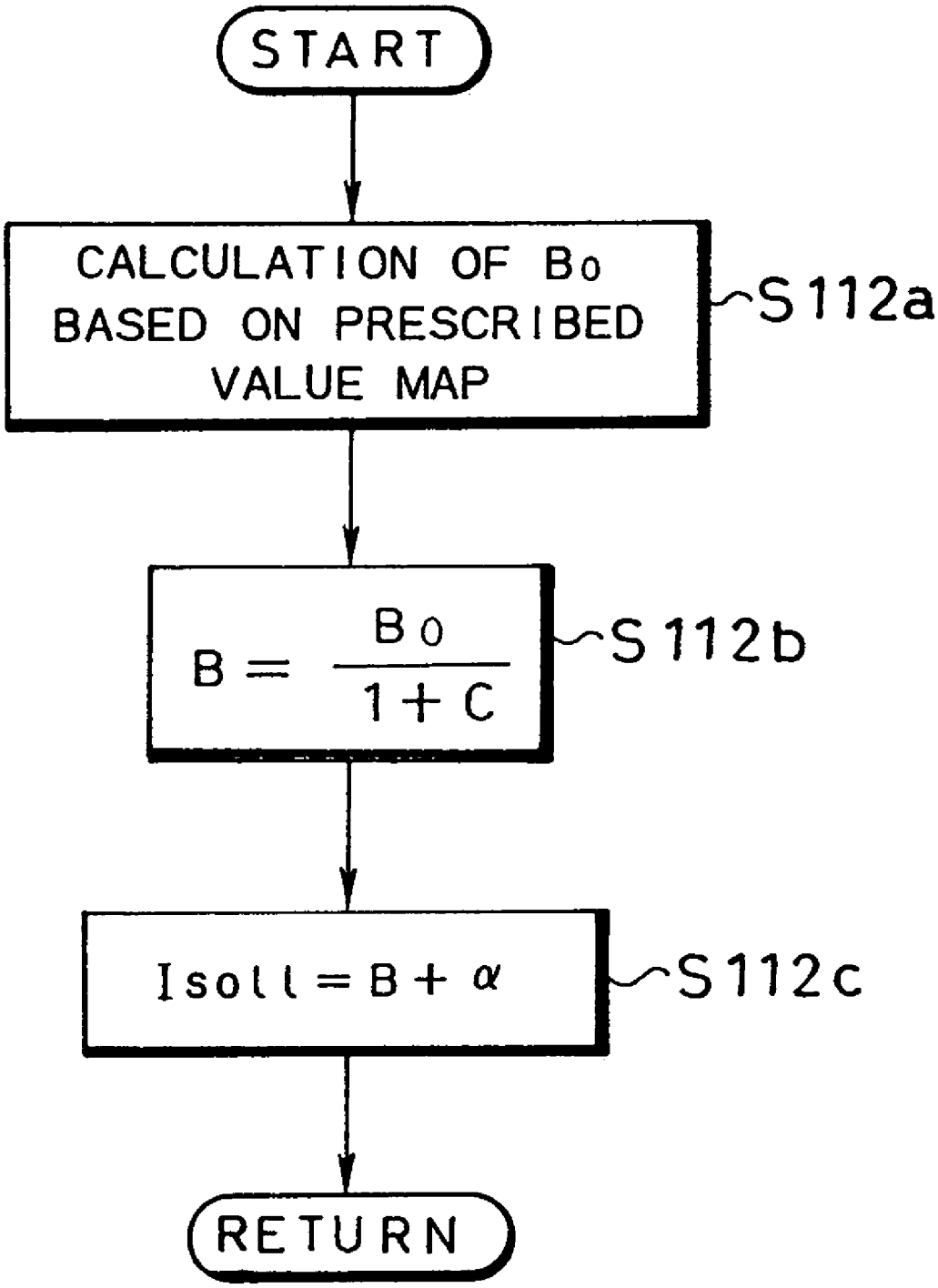
FIG. 3 is a flowchart showing the process of a driving current correction procedure in the flowchart shown in FIG. 2.

Next, an actual driving current value B is derived using this obtained driving current $B_0$ and the correction coefficient C previously obtained (refer to Step S112*b* in FIG. 3). Specifically, the actual driving current value B is calculated as $B=B_0/(1+C)$ (refer to FIG. 5).

Here, the derivation of $B=B_0/(1+C)$ will be explained. First, $(B_0-B)/B$ equals the aforesaid correction coefficient C, where B is the driving current that is actually required for the desired common rail pressure $P_{soll}$. Therefore, $C=(B_0-B)/B$. Then, multiplying both sides of this equation by B gives $C \cdot B=B_0-B$. Then, transposing B to the left side and calculating the equation can give $B=B_0/(1+C)$.

Next, the control proceeds to Step S112*c*, in which a conclusive actual driving current is determined. Specifically, a conclusive actual driving current $I_{soll}$ in which the learning result is reflected is determined as $I_{soll}=B+\alpha$. Here, $\alpha$ is an allowance current for bringing the high-pressure control solenoid valve 11 into a completely closed state.

Then, after the driving current $I_{soll}$ to be actually supplied to the high-pressure control solenoid valve 11 is calculated in the above-described manner, the control returns to the not-shown main routine process via the subroutine process shown in FIG. 2, and the aforesaid driving current $I_{soll}$ is outputted to the high-pressure control solenoid valve 11 from the control unit 5 in the not-shown main routine process.

Next, a second operation control example will be explained with reference to FIG. 6 to FIG. 12.

This second operation control relates in particular to driving control of the low-pressure control solenoid valve 7 and the high-pressure control solenoid valve 11, and is conducted to change over the operation between the low-pressure control solenoid valve 7 and the high-pressure control solenoid valve 11 according to the operation state of the common-rail fuel injection device.

Figure 6:
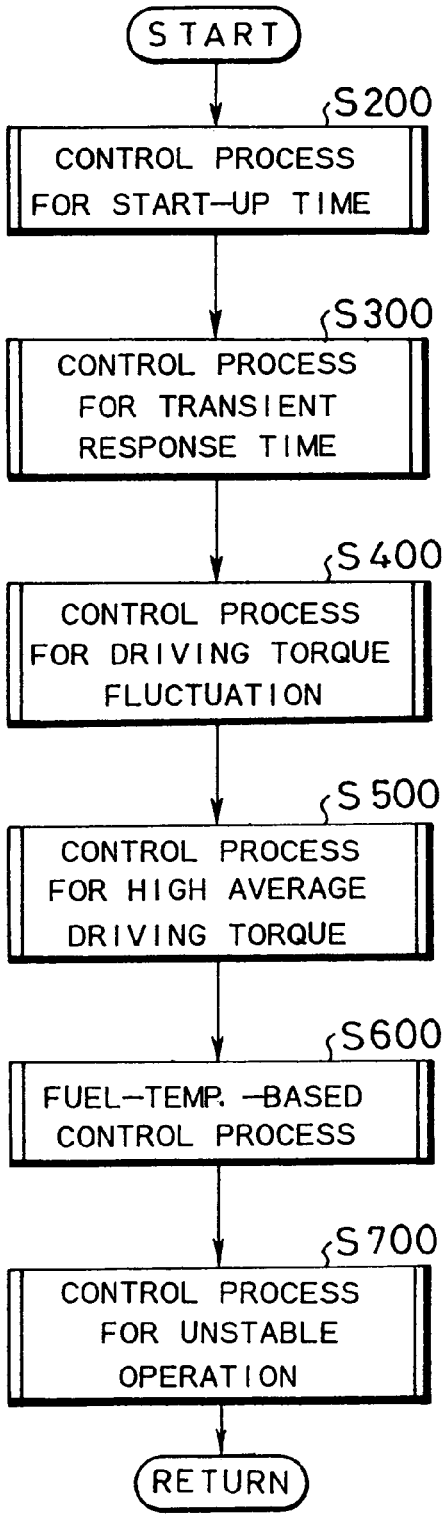
FIG. 6 is a flowchart showing the overall process of switching control between a low-pressure control solenoid valve and a high-pressure control solenoid valve, which is executed in the control unit in the common rail injection device shown in FIG. 1.

This second operation control is executed as one subroutine process in the main routine process (not shown) including other control processes executed by the control unit 5. FIG. 6 shows the overall process of this second operation control. Hereinafter, the contents thereof will be explained with reference to this drawing. In this second operation control, which consists of six subroutines as will be described next, a control process for start-up time is first executed (refer to Step S200 in FIG. 6). In this, it is determined whether or not an engine is at its start-up. When the engine is at its start-up, the high-pressure control solenoid valve 11 is driven to control the common rail pressure (to be detailed later).

Next, a control process for a transient response state is executed (refer to Step S300 in FIG. 6). In this, it is determined whether or not the operation state of the common-rail fuel injection device is a predetermined transient state. When it is judged that it is the predetermined transient state, the high-pressure control solenoid valve 11 is driven, thereby controlling the common rail pressure (to be detailed later).

Next, a control process for driving torque fluctuation is executed (refer to Step S400 in FIG. 6). In this, when a driving torque of the high-pressure pump 2 fluctuates, the high-pressure control solenoid valve 11 is driven to control the common rail pressure (to be detailed later).

Next, a control process for high average driving torque is executed (refer to Step S500 in FIG. 6). In this, when an average driving torque of the high-pressure pump 2 is high, the low-pressure control solenoid valve 7 is driven to control the common rail pressure (to be detailed later).

Next, a fuel-temp.-based control process is executed (refer to Step S600 in FIG. 6). In this, the driving is changed over between the low-pressure control solenoid valve 7 and the high-pressure control solenoid valve 11 according to the fuel temperature to control the common rail pressure (to be detailed later).

Finally, a control process for unstable operation is executed (refer to Step S700 in FIG. 6), and after this process, the control returns to the not-shown main routine process. In this control process for unstable operation, in a predetermined unstable operation state, the high-pressure control solenoid valve 11 is driven to control the common rail pressure (to be detailed later).

Here, it is well known in the art that high-pressure (discharge or downstream) side control and low-pressure (intake or upstream) side control are available for controlling the common rail pressure, each having its own merits and demerits. For reference for the operation controls to be explained below, the respective merits and demerits of the high-pressure (discharge) side control and the low-pressure (intake) side control will be briefly described.

First, the high-pressure (discharge) side control is a control method in which the high-pressure control solenoid valve 11 is driven, with an amount of oil to be fed to the common rail 4 from the high-pressure pump 2 being kept fixed, and unnecessary fuel is released from the high-pressure side, thereby obtaining a desired value for the common rail pressure. A fuel injection amount from the injection nozzles 3, namely, an effective discharge amount in such high-pressure (discharge) side control is generally expressed as follows:

effective discharge amount=discharge amount of high pressure pump−volume removal (released) amount through solenoid valve−(leak amount from injection nozzles and so on).

In the above equation, the volume removal amount from the solenoid valve means an amount of the fuel returned to the fuel tank 1 from the common rail 4 via the high-pressure control solenoid valve 11 (namely, the release amount). Examples of the merits of such high-pressure (discharge) side control include good responsiveness in common rail pressure and small fluctuation of pump driving torque. On the other hand, examples of the demerits thereof include a high average pump driving torque (in other words, a large amount of wasteful work). The large amount of wasteful work indicates a large increase in fuel temperature.

Meanwhile, the low-pressure (intake) side control means that the low-pressure control solenoid valve 7 is driven so as to obtain only an amount of fed oil necessary for controlling the common rail pressure. This is a control method in which an intake amount to the high-pressure pump 2 is controlled, thereby controlling the common rail pressure at a desired value. A fuel injection amount, namely, an effective discharge amount, from the injection nozzles 3 in such low pressure (intake) side control is typically expressed as follows:

effective discharge amount=discharge amount of high pressure pump−(leak amount from injection nozzles and so on).

An example of the merits of the high-pressure pump 2 side in such low-pressure (intake) side control is a low average pump driving torque (in other words, a small amount of wasteful work). This indicates, contrary to the case of the high-pressure (discharge) side control, a small increase in fuel temperature. On the other hand, one of the demerits is that responsiveness in the common rail pressure tends to be low, resulting in a large variation in driving torque (in other words, a large driving noise).

Next, the contents of each of the subroutine processes described above will be explained with reference to FIG. 7 to FIG. 12.

First, the control process for start-up time will be explained with reference to FIG. 7. When the operation control is started, it is determined whether or not the engine is in a start-up state (refer to Step S202 in FIG. 7). The determination of whether or not the engine is in the start-up state is preferably made based on an engine rotation speed Ne, position information of an ignition engine key (not shown), and the common rail pressure that are inputted to the control unit 5.

Then, when it is determined that the engine is in the start-up state (in a case of YES), the control proceeds to a process in Step S204 to be described next. When it is determined that the engine is not in the start-up state (in a case of NO), the control proceeds to a process in Step S212 to be described later (refer to Step S202 in FIG. 7).

In Step S204, the high-pressure (discharge) side control is executed in response to the determination that the engine is in the start-up state. Specifically, when the engine is in the start-up state, the execution of a highly responsive control is desired for control of the common rail pressure during a period from the initial explosion of the engine at least until it becomes stable in an idling state. Therefore, the high-pressure (discharge) side control is suitable. Accordingly, the control unit 5 controls the high-pressure control solenoid valve 11 to be driven so as to set a necessary common rail pressure.

Figure 7:
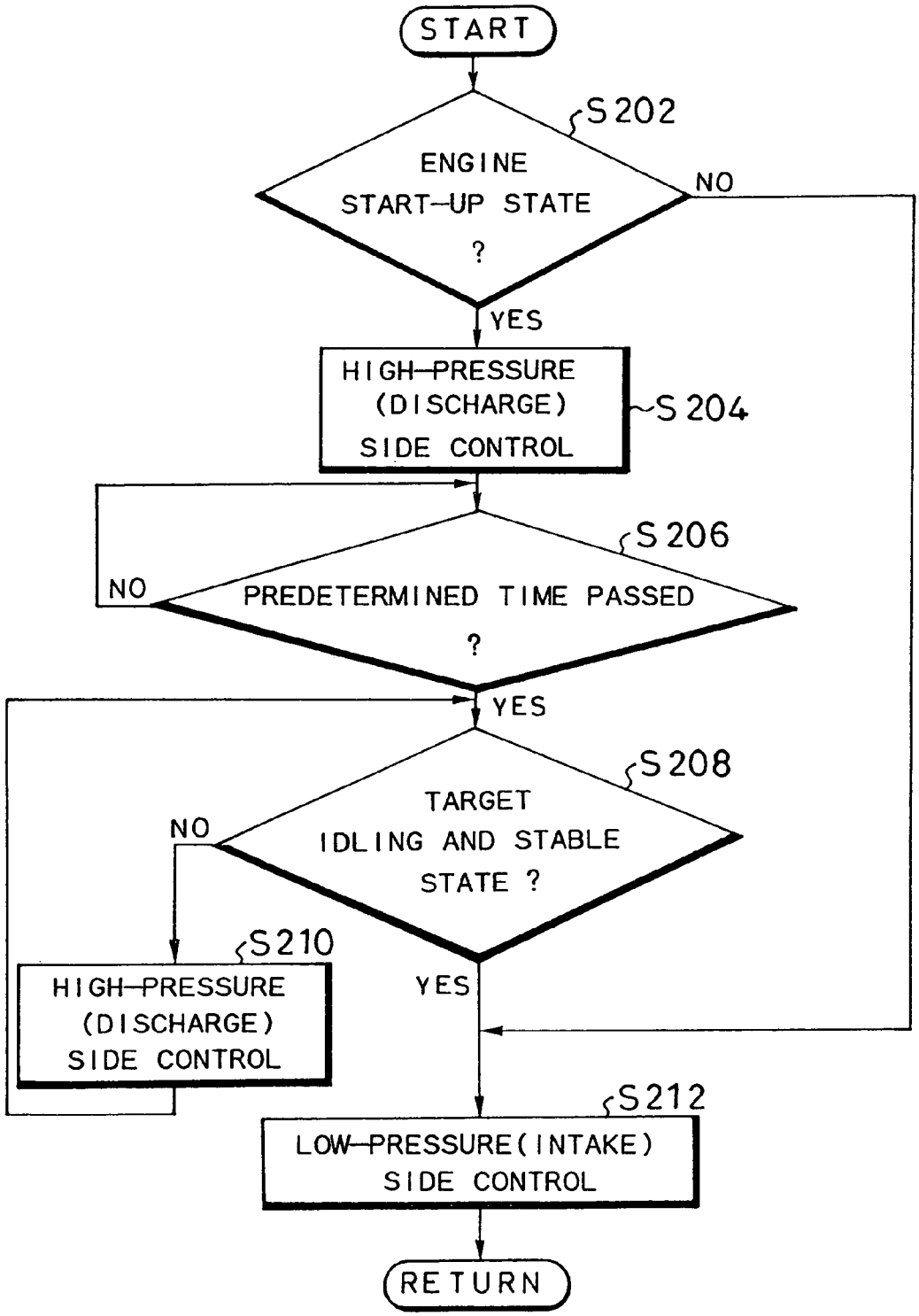
FIG. 7 is a flowchart showing the process of a control procedure for start-up time.

Next, it is determined whether or not a predetermined period of time has passed from the engine start-up (refer to Step S206 in FIG. 7). When it is determined that the predetermined period of time has passed, it is determined whether or not the common rail pressure has reached a target idling and stable state (refer to Step S208 in FIG. 7).

Here, the target idling and stable state means the state of the common rail pressure when the not-shown engine is in an idling state and substantially in a stable state. The determination as to whether or not the engine is in the target idling and stable state is suitably made based on whether or not the engine rotation speed Ne inputted to the control unit 5 and the common rail pressure detected by the high-pressure sensor 12 and inputted to the control unit 5 are within predetermined ranges, respectively.

In Step S208, when it is determined that the common rail pressure is in the target idling and stable state (in a case of YES), the control proceeds to a process in Step S212 to be described next. On the other hand, when it is determined in Step S208 that the common rail pressure is not in the target idling and stable state (in a case of NO), the high-pressure (discharge) side control is continued until it is determined that the common rail pressure is in the target idling and stable state (refer to Steps S210 and S208 in FIG. 7).

After it is determined in Step S202 that the engine is not in the start-up state (in a case of NO), or after it is determined in Step S208 that the common rail pressure has reached the target idling and stable state (in a case of YES), the required responsiveness of the common rail pressure is not very high. Therefore, the high-pressure (discharge) side control that has been executed up to the current moment is changed to the low-pressure (intake) side control, in which the low-pressure control solenoid valve 7 instead of the high-pressure control solenoid valve 11 is controlled to be driven to adjust the common rail pressure (refer to Step S212 in FIG. 7). Thereafter, the control tentatively returns to the aforesaid routine shown in FIG. 6.

Next, the control process for a transient response state will be explained with reference to FIG. 8.

Figure 8:
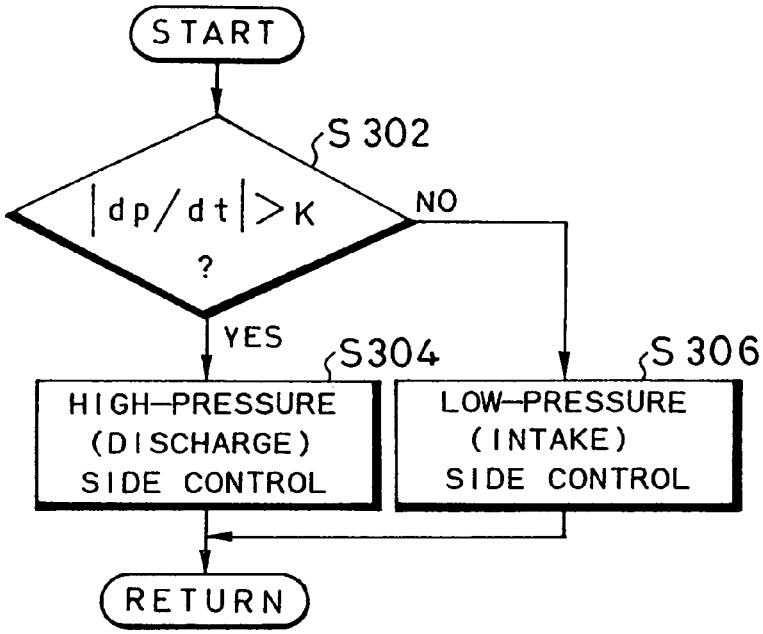
FIG. 8 is a flowchart showing the process of a control procedure for transient response state.

When the operation control is started, it is first determined whether or not the operation of this device is in a transient response state (refer to Step S302 in FIG. 8). Specifically, first, the transient response state here means the case which the common rail pressure needs to be reduced or increased by a predetermined value or more. This state occurs, for example, when a drastic change occurs in an accelerator depression amount, and so on.

The determination of whether the transient response state exists or not is suitably made, for example, based on whether or not an absolute value of a variation amount dP/dt of the common rail pressure per unit time exceeds a predetermined value K. This predetermined value K is suitably determined based on, for example, fuel temperature, the temperature of an engine cooling water, and so on, and though one value may be selected based on experimental values, empirical data, and so on thereof, it is also suitable that several values are selectively used according to the fuel temperature and the temperature of the engine cooling water.

When it is determined in this Step S302 based on the aforesaid criteria that the operation of this device is in the predetermined transient response state (in a case of YES), the low-pressure (intake) side control cannot follow the variation in the common rail pressure as required. Accordingly, the high-pressure (discharge) side control is executed (refer to Step S304 in FIG. 8). On the other hand, when it is determined in Step S302 that the operation of this device is not in the predetermined transient response state (in a case of NO), the low-pressure (intake) side control is maintained (refer to Step S306 in FIG. 8). Then, after either one of Steps S304 and S306 is executed, the control tentatively returns to the aforesaid routine shown in FIG. 6.

Next, the control process for driving torque fluctuation will be explained with reference to FIG. 9.

Figure 9:
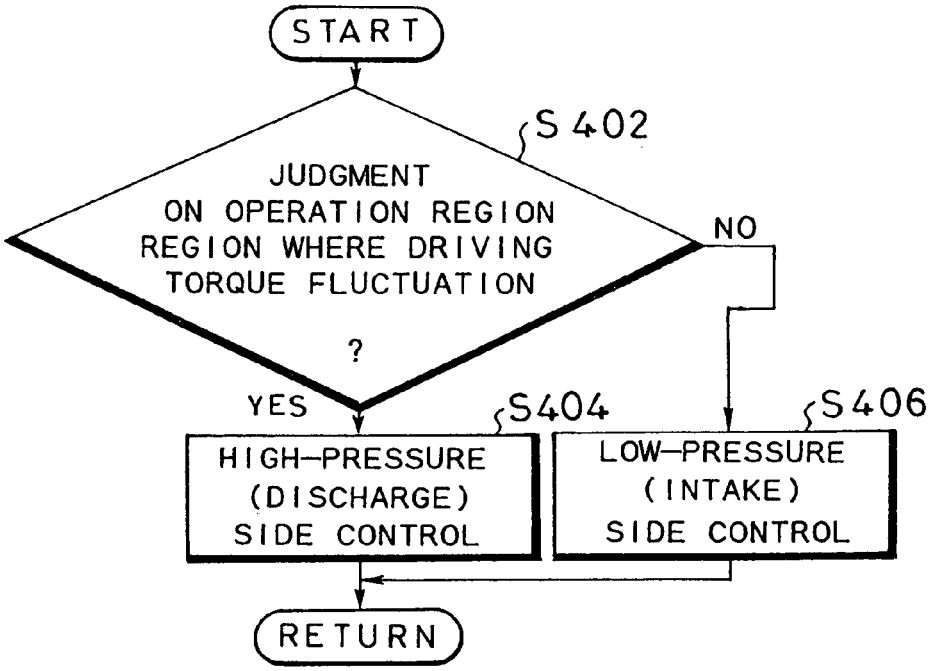
FIG. 9 is a flowchart showing the process of a control procedure for driving torque fluctuation.

When the operation control is started, it is first determined whether or not the operation state of this device is in an operation state in which a driving torque fluctuation is problematic (refer to Step S402 in FIG. 9). Specifically, first, "the driving torque fluctuation is problematic" here means that a fluctuation of the driving torque occurs due to some reason in the low-pressure (intake) side control state, and a so-called driving noise may occur if the low-pressure (intake) side control is continued, so that it becomes impossible to obtain a stable common rail pressure. One of the factors causing the driving torque fluctuation is, for example, an intermittent oil feeding in the low-pressure (intake) side control. This means the case in which a necessary fuel is intermittently fed to the common rail 4 from the high-pressure pump 2.

The determination of the operation state in which the driving torque fluctuation is problematic is suitably made, for example, based on comparison and consideration of the engine rotation speed Ne, the common rail pressure, an oil feeding amount of the high-pressure pump 2, and so on. More specifically, it is suitable that the determination that the operation state in which the driving torque fluctuation is problematic exists is made, for example, when a variation amount of the engine rotation speed Ne, a variation amount of the common rail pressure, and a variation amount of the oil feeding amount of the high-pressure pump 2 exceed predetermined variation amounts respectively, and numerical ranges being criteria for the respective judgments are suitably set based on experiments or simulation by a computer, or further based on empirical data or the like.

Then, when it is determined in this Step S402 that this device is in the operation state in which the driving torque fluctuation is problematic (in a case of YES), the high-pressure (discharge) side control is executed (refer to Step S404 in FIG. 9). On the other hand, when it is determined that this device is not in the operation state in which the driving torque fluctuation is problematic (in a case of NO), the low-pressure (intake) side control is maintained (refer to Step S406 in FIG. 9). Then, after either one of Steps S404 and S406 is executed, the control tentatively returns to the aforesaid routine shown in FIG. 6.

Next, the control process for high average driving torque will be explained with reference to FIG. 10.

Figure 10:
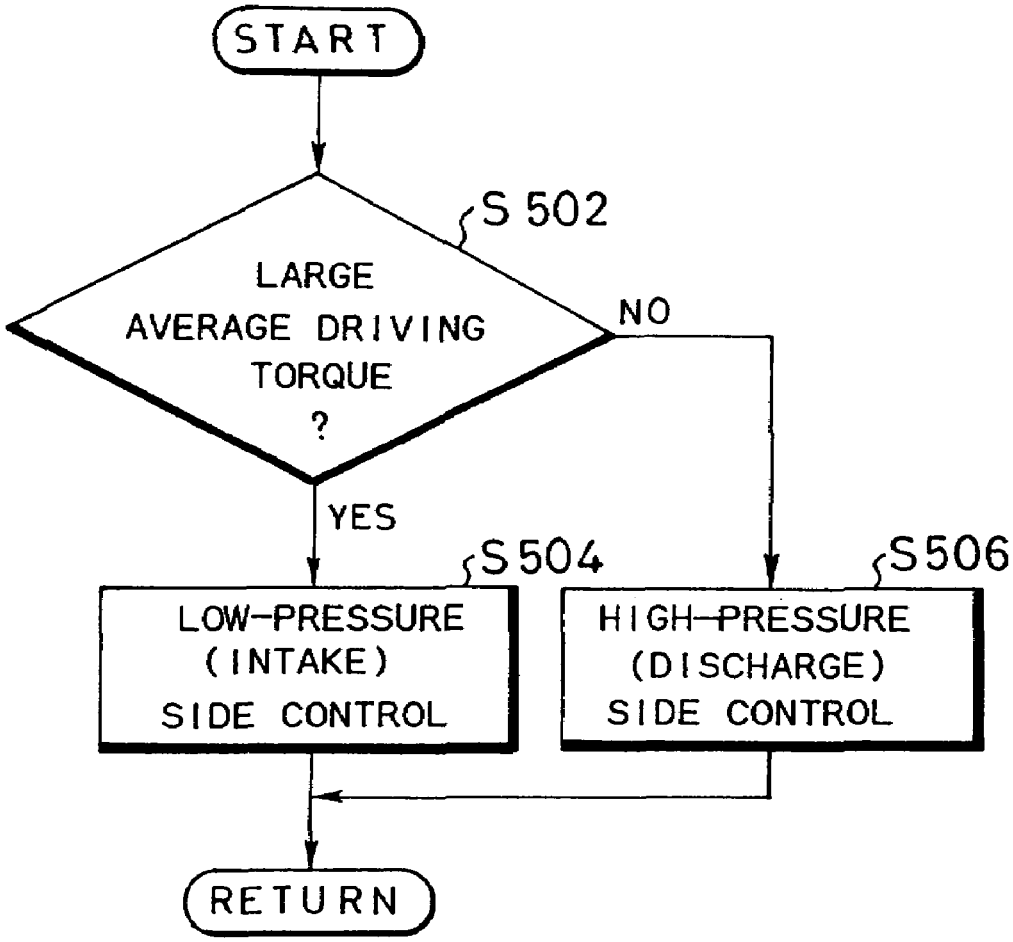
FIG. 10 is a flowchart showing the process of a control procedure for high average driving torque.

When the operation control is started, it is first determined whether or not this device is in the operation state with a high average driving torque (refer to Step S502 in FIG. 10). Specifically, first, the operation state with the high average driving torque means the state in which an amount of wasteful work is large in the state of the high-pressure (discharge) side control. The determination of whether the operation state with the high average driving torque exists may be made in such a manner that an average driving torque at the current moment is derived through an arithmetic operation and it is determined whether or not the derived result exceeds a predetermined value. Alternatively, the determination may be made by determining that the increase in fuel temperature is equal to a predetermined value or higher.

Then, when it is determined in this Step S502 that this device is in the operation state with the high average driving torque (in a case of YES), the high-pressure (discharge) side control is changed to the low-pressure (intake) side control, so that the low-pressure (intake) side control is executed (refer to Step S504 in FIG. 10). On the other hand, when it is determined that this device is not in the operation state with the high average driving torque (in a case of NO), the high-pressure (discharge) side control is maintained (refer to Step S506 in FIG. 10). Then, after either one of Steps S504 and S506 is executed, the control tentatively returns to the aforesaid routine shown in FIG. 6.

Next, the fuel-temp.-based control process will be explained with reference to FIG. 11.

Figure 11:
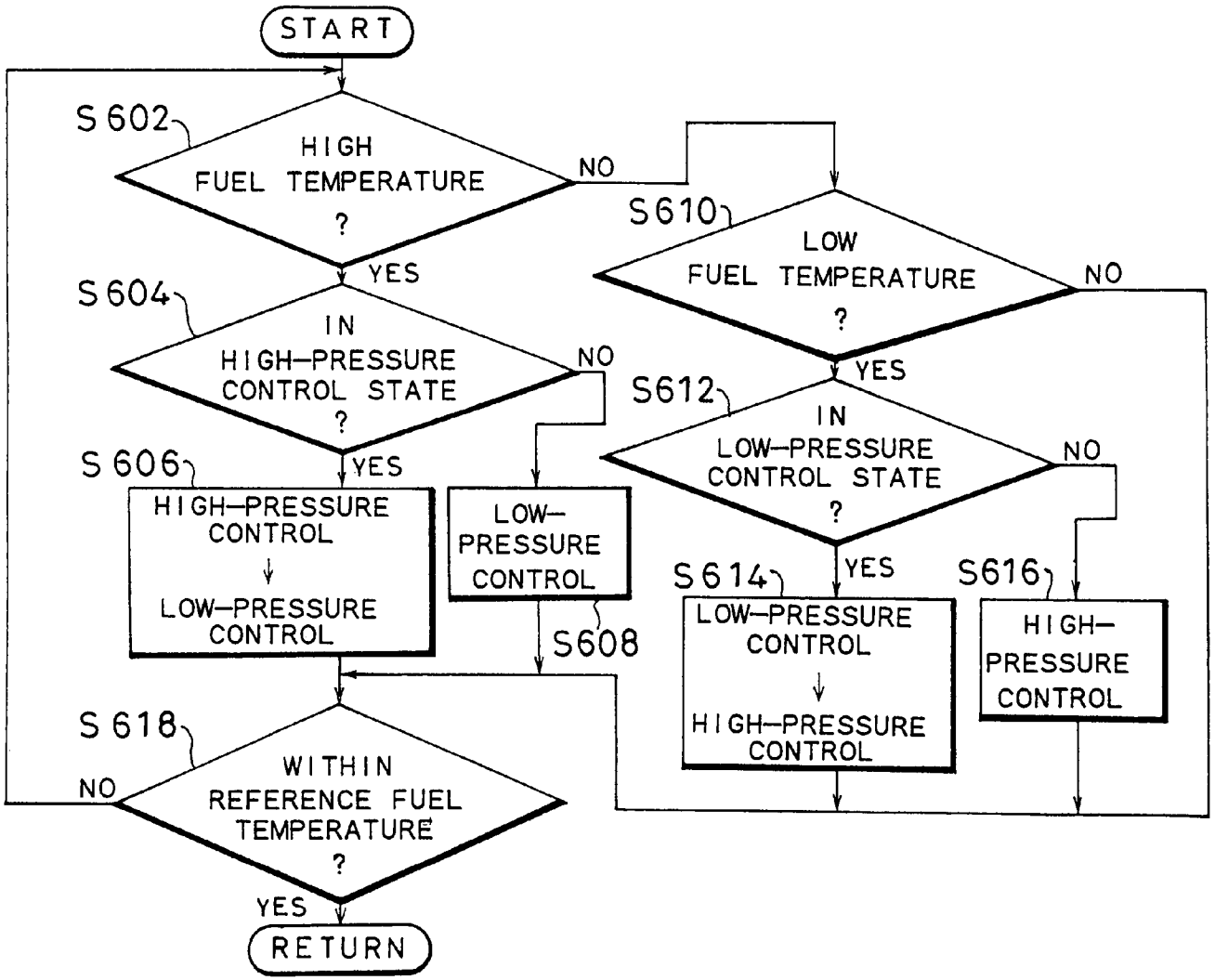
FIG. 11 is a flowchart showing the process of the fuel-temp.-based control procedure.

When the operation control is started, it is first determined whether or not a fuel temperature (fuel temp.) is in a high state in which it exceeds a predetermined high temperature reference value (refer to Step S602 in FIG. 11). Then, the determinatin that the fuel temperature exceeds the predetermined high temperature reference value, i.e., is in the high state (in a case of YES) indicates the state in which wasteful work exists in the operation of the high-pressure pump 2. Since this state requires the execution of the low-pressure (intake) side control for the purpose of decreasing the fuel temperature, it is first determined whether or not this device is in the high-pressure (discharge) side control state (refer to Step S604 in FIG. 11).

When it is determined in Step S604 that this device is in the high-pressure (discharge) side control state (in a case of YES), the high-pressure (discharge) side control is changed to the low-pressure (intake) side control, so that the low-pressure (intake) side control is executed (refer to Step S606 in FIG. 11). On the other hand, when it is determined in Step S604 that this device is not in the high-pressure (discharge) side control state (in a case of NO), the low-pressure (intake) side control is maintained (refer to Step S608 in FIG. 11).

When it is determined in the previous Step S602 that the fuel temperature is not in the high state in which the fuel temperature exceeds the predetermined high temperature reference value (in a case of NO), it is determined whether or not the fuel temperature is in a low state in which it is lower than a predetermined low temperature reference value (refer to Step S610 in FIG. 11). Then, when it is determined that the fuel temperature is lower than the predetermined low temperature reference value, i.e., in the low state (in a case of YES), it is necessary to execute the high-pressure (discharge) side control for the purpose of increasing the fuel temperature. Therefore, it is first determined whether or not the current state is the low-pressure (intake) side control state (refer to Step S612 in FIG. 11).

When it is determined in Step S612 that the current state is the low-pressure (intake) side control state (in a case of YES), the low-pressure (intake) side control is changed to the high-pressure (discharge) side control, so that the high-pressure (discharge) side control is executed (refer to Step S614 in FIG. 11). On the other hand, when it is determined in Step S612 that the current state is not the low-pressure (intake) side control state (in a case of NO), the high-pressure (discharge) side control is maintained (refer to Step S616 in FIG. 11).

Then, after any one of Steps S606, S608, S614, and S616 is executed, it is determined whether or not the fuel temperature is within a predetermined reference range (refer to Step S618 in FIG. 11). When it is determined that the fuel temperature is not within the predetermined reference range (in a case of NO), the control returns to the previous Step S602 and the series of steps is repeated. When it is determined that the fuel temperature is within the predetermined reference range (in a case of YES), the control tentatively returns to the aforesaid routine shown in FIG. 6.

Next, the control process for unstable operation will be explained with reference to FIG. 12.

Figure 12:
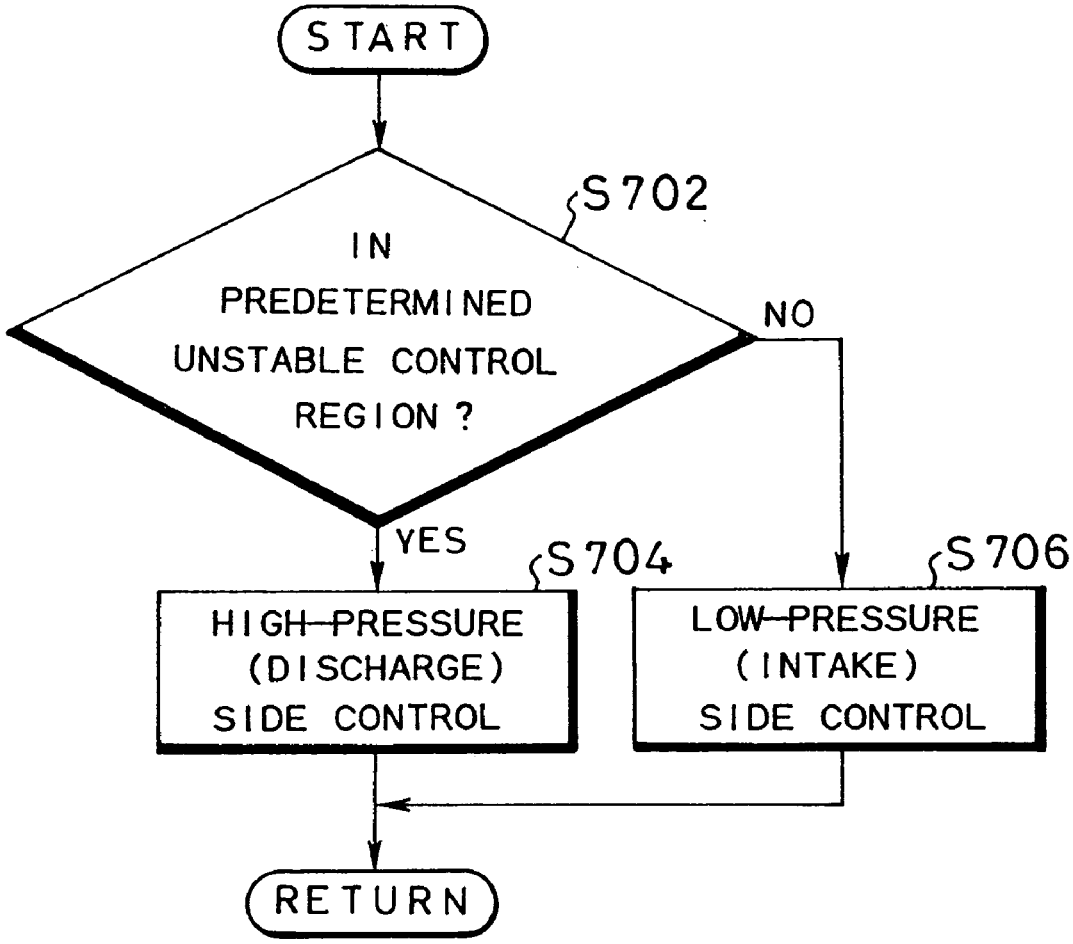
FIG. 12 is a flowchart showing the process of a control procedure for unstable operation.

When the operation control is started, it is first determined whether or not the operation of this device (in other words, the state of the fuel injection control) is in a predetermined unstable operation region (refer to Step S702 in FIG. 12).

Here, the case in which the determination that the predetermined unstable operation region exists is made corresponds to a case, first based on the premise that the current operating state is the low-pressure (intake) side control state, where it is concerned that mechanical vibration may occur in a mechanical valve in this device due to the fact that a controlled amount of the injected fuel is injected at a smaller flow rate compared with that in the case of the high-pressure (discharge) side control, or where there is a possibility that a cavity may occur due to intake restriction on the high-pressure pump 2. Accordingly, there is concern that reliability of the operation of this device may possibly lower. More specific judgment criteria include a controlled flow rate of the fuel in the former case, and an amount of intake restriction in the latter case, but specific appropriate values thereof depend on factors such as the actual scale, operation conditions, and so on of the device. Therefore, the values should be set in consideration of these factors.

Then, when it is determined in Step S702 based on the aforesaid judgment criteria that the operation of this device is in the predetermined unstable operation region (in a case of YES), the high-pressure (discharge) side control is executed in place of the low-pressure (intake) side control (refer to Step S704 in FIG. 12). When it is determined that the operation of this device is not in the predetermined unstable operation region (in a case of NO), the low-pressure (intake) side control is maintained (refer to Step S706 in FIG. 12). Then, after either one of Steps S704 and S706 is executed, the control tentatively returns to the aforesaid routine shown in FIG. 6.

In the configuration example described above, roughly six kinds of control procedures, starting from the control procedure for start-up time (refer to Step S200 in FIG. 6) up to the control procedure for unstable operation (refer to Step S700 in FIG. 6), are executed as the control procedures in which the driving is changed over between the low-pressure control solenoid valve 7 and the high-pressure control solenoid valve 11, as shown in FIG. 6. However, it is not always necessary to execute all of these control procudures, and such a configuration may of course be adopted that, for example, only any one of the six kinds of control procedures is executed, in consideration of the actual scale, required performance, and so on of the device. In addition, an arbitrary number of controls among the aforesaid six kinds of controls may be combined.

Further, in the configuration example described above, the low-pressure control solenoid valve 7 is disposed at an appropriate position in the fuel pipe 8 connecting the fuel tank 1 and the high-pressure pump 2 as an example of disposing the low-pressure control solenoid valve 7 therebetween, but the configuration is of course not limited to this, and it may be disposed in the high-pressure pump 2. Moreover, though the high-pressure control solenoid valve 11 is disposed at an appropriate position in the fuel pipe 8 between the common rail 4 and the fuel tank 1, the high-pressure control solenoid valve 11 may of course be disposed more directly downstream of the high-pressure pump 2. In other words, the high-pressure control solenoid valve 11 may be disposed at an appropriate position in an area from the high-pressure pump 2 up to the injection nozzles 3.

As described hitherto, according to the present invention, a configuration is adopted so that the driving current to the high-pressure control solenoid valve that is determined by the prescribed value map is corrected according to an actual driving state under predetermined conditions, which brings about such an effect that appropriate and reliable fuel injection is can be realized. This correction is conducted by responding to a variation in operational characteristics of high-pressure control solenoid valves and a difference in operation conditions among individual devices.

Further, according to the present invention, a configuration is adopted so that the control is changed over between the high pressure side control and the low pressure side control in accordance with various operation states of the device. This change brings about such an effect that the responsiveness in the common rail pressure is improved, so that control stability is improved, and stable and reliable fuel injection can be realized. In addition, with a configuration in which the high-pressure side control and the low-pressure side control are provided, even when one of them is in fault, the other control can cope with the situation, which brings about such an effect that safety and reliability of the device against fault can be improved. Further, with such a configuration in which the control is changed over between the high-pressure side control and the low-pressure side control, compared with such a configuration in which only the high-pressure side control is executed, the load of the high-pressure pump can be reduced by also executing the low-pressure side control, which brings about an effect that reliability of the high-pressure pump can be improved.

As described hitherto, a fuel injection device according to the present invention is a device that injects and supplies fuel to an internal combustion machine such as an engine for vehicles, and is particularly suitable for those with the configuration of a so-called common-rail type.

What is claimed is:

1. An operation control method using a fuel injection device, comprising:

pressurizing fuel from a fuel tank using a high-pressure pump so that the pressurized fuel is stored in a common rail;

supplying the pressurized fuel stored in the common rail to an injection nozzle connected to the common rail; and controlling the pressure of the pressurized fuel stored in the common rail by using a low-pressure control solenoid valve upstream of the high-pressure pump, and by using a high-pressure control solenoid valve downstream of the high-pressure pump, the low-pressure control solenoid valve and the high-pressure control solenoid valve being selectively feedback-controlled to control the pressure of the pressurized fuel stored in the common rail;

wherein, when a pressure in the common rail exceeds a predetermined value and the high-pressure control solenoid valve is being used to control the pressure of the pressurized fuel stored in the common rail, said controlling comprises:

determining a driving current of the high-pressure control solenoid valve using a prescribed value map defining a correlation between the pressure of the pressurized fuel stored in the common rail and the driving current of the high-pressure control solenoid valve;

correcting the determined driving current of the high-pressure control solenoid valve based on an actual pressure in the common rail and the driving current of the high-pressure control solenoid valve at the actual pressure; and supplying the corrected driving current to the high-pressure control solenoid valve.

2. The operation control method of claim 1, wherein said selective feedback-controlling of one of the low-pressure control solenoid valve and the high-pressure control solenoid valve comprises selectively driving one of the low-pressure control solenoid valve and the high-pressure control solenoid based at least in part on a detected pressure of the pressurized fuel in the common rail.

3. A fuel injection device comprising:

a fuel tank for storing fuel;

a common rail for storing pressurized fuel;

a high-pressure pump connected to said fuel tank and said common rail, said high-pressure tank being operable to pressurize fuel from said fuel tank so that the pressurized fuel is stored in said common rail;

an injection nozzle connected to said common rail so as to receive the pressurized fuel from said common rail;

a low-pressure control solenoid valve upstream of said high-pressure pump;

a high-pressure control solenoid valve downstream of said high-pressure pump; and a control unit for selectively feedback-controlling said low-pressure control solenoid valve and said high-pressure control solenoid valve to control the pressure of the pressurized fuel stored in said common rail, said control unit having a prescribed value map stored therein, said prescribed value map defining a correlation between the pressure in said common rail and a driving current of said high-pressure control solenoid valve;

wherein, when said control unit selectively feedback-controls said high-pressure control solenoid valve, said control unit is operable to:

determine a driving current of said high-pressure control solenoid valve for a desired pressure in said common rail based on said prescribed value map;

supply the determined driving current to said high-pressure control solenoid valve until the pressure in said common rail is judged to exceed a predetermined variation amount;

when the pressure in said common rail is judged to exceed the predetermined variation amount, correct the driving current determined using the prescribed value map based on an actual pressure in said common rail and the driving current of said high-pressure control solenoid value at the actual pressure; and pass the corrected driving current to said high-pressure control solenoid value.

4. The fuel injection device of claim 3, wherein said control unit is further operable to selectively drive one of said low-pressure control solenoid valve and said high-pressure control solenoid valve based on a temperature of the fuel, a pressure in said common rail, a rotation speed of the engine, an accelerator depression amount, and position information of an ignition engine key.

* * * * *